US006457529B2

(12) United States Patent
Calder et al.

(10) Patent No.: US 6,457,529 B2
(45) Date of Patent: Oct. 1, 2002

(54) APPARATUS AND METHOD FOR RETURNING DRILLING FLUID FROM A SUBSEA WELLBORE

(75) Inventors: Ian Douglas Calder, Houston, TX (US); Ready J. Johnson, Houston, TX (US); John Nelson, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 36 days.

(21) Appl. No.: 09/788,058

(22) Filed: Feb. 16, 2001

Related U.S. Application Data

(60) Provisional application No. 60/183,201, filed on Feb. 17, 2000.

(51) Int. Cl.[7] ..... E21B 7/12

(52) U.S. Cl. ..... 166/368; 175/5; 175/7; 175/217; 175/213

(58) Field of Search ..... 175/5, 7, 217, 175/213, 65, 66, 57; 166/368, 358, 336, 250.17, 250.15

(56) References Cited

U.S. PATENT DOCUMENTS 1,758,875 A * 5/1930 Zublin ..... 175/217
2,218,533 A * 10/1940 Huebotter ..... 175/217
2,914,306 A * 11/1959 Failing ..... 166/191
3,024,853 A * 3/1962 Herbold ..... 173/151
3,791,442 A * 2/1974 Watkins ..... 166/352
4,063,602 A * 12/1977 Howell et al. ..... 175/48
4,091,881 A 5/1978 Maus ..... 175/7
4,099,583 A * 7/1978 Maus ..... 175/25
4,149,603 A 4/1979 Arnold ..... 175/7
4,291,772 A * 9/1981 Beynet ..... 175/25
4,577,700 A * 3/1986 Dellinger et al. ..... 175/212
4,813,495 A * 3/1989 Leach ..... 166/358
5,873,420 A * 2/1999 Gearhart ..... 175/25
6,328,107 B1 * 12/2001 Maus ..... 166/335

* cited by examiner

*Primary Examiner*—Thomas B. Will
*Assistant Examiner*—Thomas A. Beach
(74) *Attorney, Agent, or Firm*—Bracewell & Patterson, L.L.P.

(57) ABSTRACT

An apparatus and method are provided for controlling hydrostatic pressure in drilling fluid in a subsea well. A main pump forces drilling fluid down the drill pipe, out of the end of the drill pipe, and upward in an annulus surrounding the pipe. A rotating drilling head is attached to a wellhead assembly at the sea floor. The drilling head has an inner body rotatably carried in an outer body landed in a bore of a housing. An energizable gripper in a bore of the inner body grips an outer surface of the drill pipe. The drilling head diverts the drilling fluid into a lateral passage in the sidewall of the housing. An auxiliary pump forces seawater through a venturi into a conduit, creating a lower pressure to draw drilling fluid into the conduit to be carried back to the surface vessel. Pressure and flow rate measurements are sent to a control system that modulates the speed of each pump to control hydrostatic pressure.

21 Claims, 2 Drawing Sheets

APPARATUS AND METHOD FOR RETURNING DRILLING FLUID FROM A SUBSEA WELLBORE

CROSS REFERENCE TO RELATED APPLICATIONS

Benefit is herein claimed of the filing date under 35 USC §119 and/or §120 and CFR 1.78 to U.S. Provisional Patent Application Serial No. 60/183,201, filed on Feb. 17, 2000, and entitled "Eduction Pump for Riserless Drilling."

FIELD OF THE INVENTION

This invention relates to a subsea well drilling system. More particularly, this invention relates to a well assembly having a rotating seal, a means for measuring and controlling the downhole pressure of drilling mud, and a pump placed near the well for pumping the drilling mud back to the surface.

DESCRIPTION OF THE PRIOR ART

To remove the load on the main drilling fluid pump while drilling a well, it is known in the art to provide an auxiliary pump for returning the drilling fluid to the surface. In fact, using this type of system may obviate the need for a riser, as shown in U.S. Pat. No. 4,149,603. However, reciprocating pumps are difficult to use in subsea locations, and the abrasiveness of cuttings entrained in the drilling fluid can destroy the internal components of a centrifugal pump.

Excessive hydrostatic pressure in drilling fluids used while drilling a well may damage surrounding formations. One method of alleviating pressure in the column of fluid in the annulus is shown in U.S. Pat. No. 4,091,881. Fluid is drawn out of the upper portion of the annulus in the riser, and an inert gas is pumped into the fluid to reduce the density of the fluid and lift the fluid through a separate conduit to the surface. The rate of gas injection is controlled to alter the hydrostatic pressure in the well.

SUMMARY OF THE INVENTION

An apparatus and method are provided for controlling hydrostatic pressure in drilling fluid in a subsea well. A main pump forces drilling fluid down the bore of a drill pipe running through a wellhead assembly. The drilling fluid exits the drill pipe at the drill bit at the bottom of the well and begins traveling upward in an annulus surrounding the drill pipe.

A rotating drilling head assembly is attached to the upper end of the wellhead assembly. The drilling head has an inner body rotatably carried in an outer body, and the outer body is landed in a bore of a housing, the bore of the housing aligning with the annulus around the drill pipe. The drill pipe is located within a bore of the inner body, and an energizable gripper located in the bore of the inner body grips an outer surface of the drill pipe. Drilling fluid travels upward in the annulus and into bore of the housing. A lateral passage is formed through a sidewall of the housing and communicates the bore of the housing. The drilling head prevents the drilling fluid from moving further upward in the bore of the housing, diverting the drilling fluid into the lateral passage. The drilling head also isolates from the well hydrostatic fluid pressure in the riser.

A submersible pump forces seawater into a conduit extending from the outlet of the pump to the surface for delivering seawater to a surface vessel. A venturi in the conduit creates a lower pressure area due to the seawater flowing through the venturi. The lateral passage of the housing is connected to the venturi, and drilling fluid is drawn out of the annulus and into the conduit. The drilling fluid mixes with the seawater to be carried back to the surface vessel.

Drilling fluid pressure and flow rate measurements are sent to a control system. The control system modulates the rate of operation of each pump for increasing or decreasing hydrostatic pressure in the fluid in the well.

DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
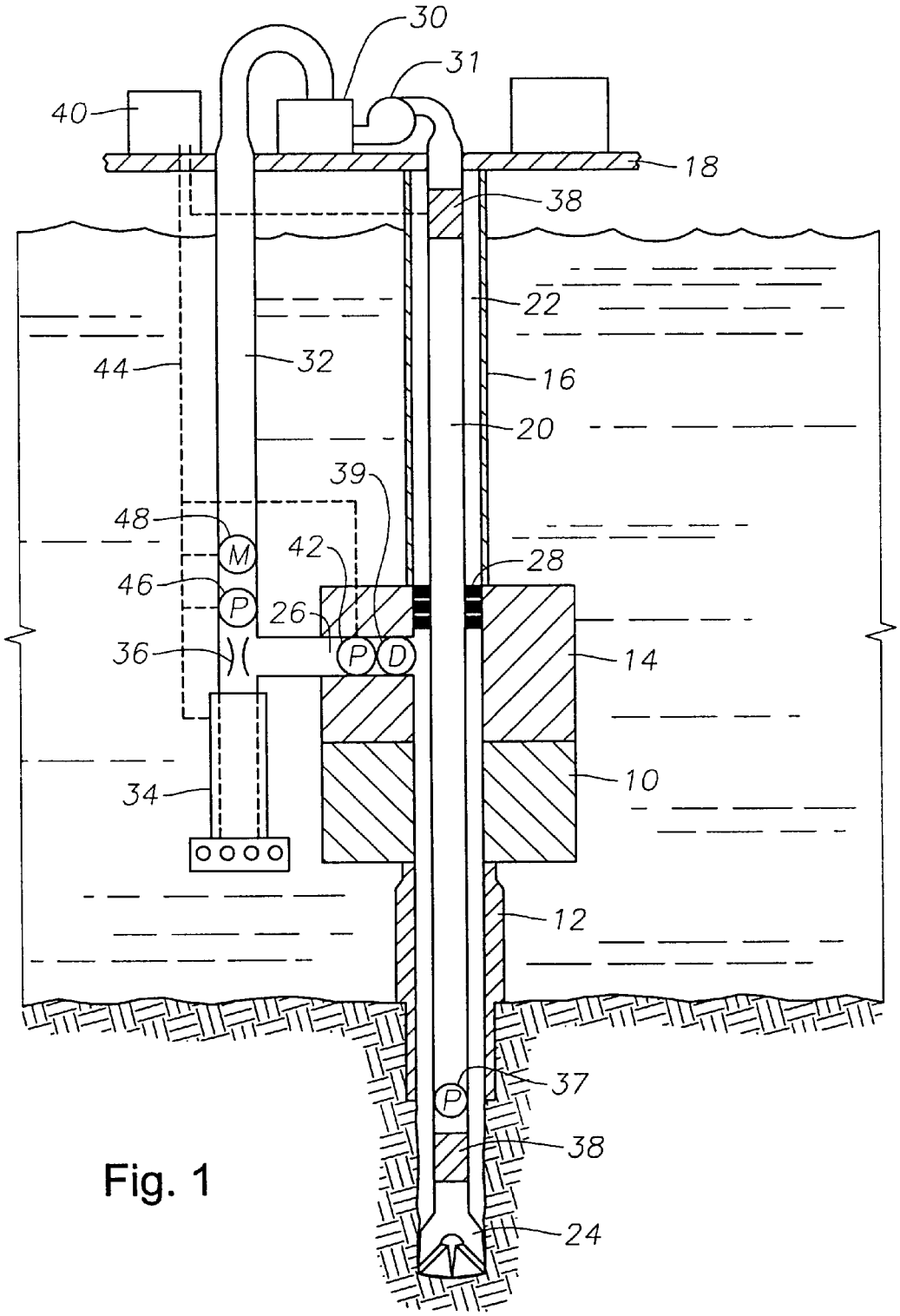
FIG. 1 is a schematic of a subsea drilling operation employing an eduction pump and pressure measurement system of the present invention.

Referring first to FIG. 1, in a subsea drilling operation employing this invention, a blow out preventer stack (BOP) 10 is landed on top of a wellhead housing assembly 12 on the sea floor. A riser drilling head or manifold 14 is joined to BOP 10 and tubular riser 16 extends from manifold 14 upwards to a floating drilling platform or drilling vessel 18 at the surface. A tubular drill string 20 extends from platform 18 concentrically through riser 16 and manifold 14 into wellhead 12, leaving an annular clearance 22 between string 20 and riser 16. Drill string 20 has a conventional drill bit 24 at its lower end which cuts into the sea floor as string 20 is rotated, thus drilling the well.

Manifold 14 has a lateral passage 26 leading off to the side, and seals around string 20 with a drilling head 28 that rotates with the drill string 20. Drilling mud is stored in a mud sump 30 on platform 18 and is pumped down through the bore of drill string 20 with a mud pump 31 on platform 18. The mud travels down string 20, out drill bit 24, and back up annulus 22 toward rotating drilling head 28. Drilling head 28 prevents the mud from continuing upward as in conventional systems, and thus the mud must exit through lateral passage 26.

A mud return line 32 is joined to lateral passage 26 and leads upward to platform 18 and back to mud sump 30. Mud return line 32 has an electric submersible pump 34 joined to is lower end and beneath passage 26. Pump 34 is positioned to draw in the surrounding sea water and pump the water up return line 30. Pump 34 is preferably a multistage centrifugal pump having a series of impellers and diffusers, wherein the impellers impart motion to sea water and the diffusers increase pressure.

Pump 34 does not contact the drilling mud itself, rather pump 34 discharges seawater into the bottom of a venturi 36 near passage 26, creating a lower pressure in passage 26 and drawing mud into mud line 32. The mud then mixes with the seawater and is carried up mud line 32 to platform 18 where the sea water is separated out and mud is returned to sump 30. This reduces the load on surface pump 31 because it does not have to pump the mud all the way back to platform 18.

A control system may be employed to automatically control pumps 31, 34. The control system may utilize a measurement while drilling (MWD) system 38, which uses an pulse generator in drill string 20 to transmit data through the annulus in the wellbore for reporting the bottom hole pressure in the well from sensor 37 to a control module 40 on platform 18. The pulses are detected by a detector 39 in manifold 14 and transmitted through umbilical 44 to the surface. A second pressure sensor 42 is positioned in passage 26 and sends a signal to control module 40 through umbilical 44 running alongside mud line 32. A third pressure sensor 46 is positioned above venturi 36 and sends a signal to control module 40 through umbilical 44. A flow meter 48 is placed above venturi 36 and sends a signal to control module 40 through umbilical 44. Control module 40 is linked to pumps 31 and 34 to control the rate at which each operates. Using the outputs from MWD 38, pressure sensors 42 and 46, and flow meter 48, control module 40 modulates pump 34 and pump 31 to balance the pressure of the drilling mud being channeled through string 20 and being drawn up through mud line 32. Control module 40 can thus control the wellbore back pressure and compensate for pressure variations in the well.

Figure 2:
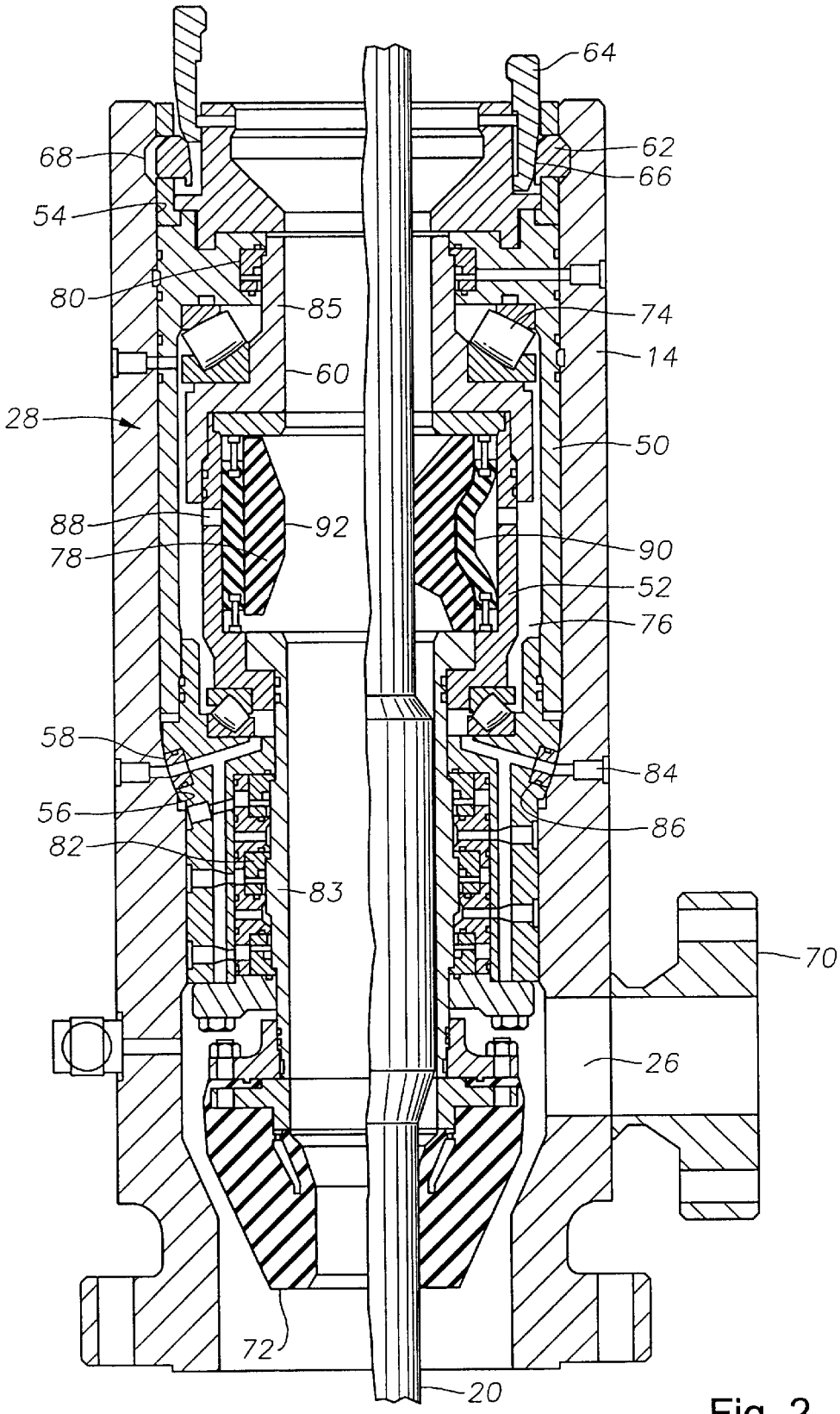
FIG. 2 is a cross-sectional view of a rotating drilling head installed in a manifold and constructed in accordance with the present invention.

The details of a preferred rotating drilling head 28 are shown in FIG. 2. Drilling head 28 prevents drilling mud from traveling up annulus 22 to the surface, causing drilling mud flowing from annulus 22 into manifold to flow into lateral passage 26 formed in the lower portion of manifold 14. Drilling head 28 comprises a tubular outer body 50 and a tubular inner body 52 rotatably carried within outer body 50 for rotating with string 20. Drilling head 28 is lowered through riser 16 (FIG. 1) until outer body 50 lands in manifold 14. Manifold 14 has a bore 54 that aligns with annulus 22 (FIG. 1) and has an upward-facing shoulder 56 formed therein for receiving a corresponding downward-facing shoulder 58 on the lower end of the outer surface of outer body 50. Inner body 52 has a bore 60 through which string 20 is lowered toward the wellbore. Drilling head 28 is releasably attached to manifold 14 by dogs 62 that are moved outwardly using a circumferential ring 64. Ring 64 has a tapered surface 66 which engages the inner surface of dogs 62 as ring 64 is moved downward, causing dogs 62 to engage recesses 68 in bore 54 of manifold 14. The left side of FIG. 2 shows ring 64 in its upper position, and dogs 62 are in their disengaged position. The right half of FIG. 2 shows ring 64 having moved downward, engaging dogs 62 and forcing them outward to engage recesses 68. Passage 26 has an external flange 70 for attaching a conduit (not shown) leading to venturi 36 (FIG.1). An elastomer stripper 72 is attached to the lower end of inner body 52 for sealingly engaging string 20.

Upper and lower tapered roller bearings 74 support inner body 52 within outer body 50 and are located within an annulus 76 defined by the outer surface of inner body 52 and the inner surface of outer body 50. An energizable, elastomer gripper 78 is located in the central portion of inner body 52. An upper metal seal 80 and three lower metal seals 82 dynamically seal outer body 50 to inner body 52. Hydraulic-fluid ports 84 in manifold 14 and openings to passages 86 in outer body 50 align when outer body 50 is landed in manifold 14. Ports 84 carry hydraulic fluid from a source exterior of manifold 14 through the sidewall of manifold 14 and into passages 86, passages 86 leading to seals 80, 82 and communicating with annulus 76. The fluid lubricates bearings 74 and seals 80, 82 and energizes gripper 78 for frictionally engaging drill string. Seals 82 slidingly engage a sleeve 83 that rotates with gripper 73 and the drill pipe. Seal 80 slidingly engages a neck 85 that is a rotating part of inner body 52.

The left side of FIG. 2 shows gripper 78 before being energized, and the right side of the figure shows gripper 78 energized and engaging string 20. Fluid pressure in annulus 76 is communicated through a hole 88 in the sidewall of inner body 52 to apply an inward force to the outer surface 90 of gripper 78. Gripper 78 expands radially inward until the inner surface 92 of gripper 78 contacts string 20. Fluid pressure is maintained in annulus 76 to ensure a sufficient frictional force between gripper 78 and string 20.

In operation, a BOP 10 is landed on wellhead housing assembly 12, and manifold 14 is joined to BOP 10. Riser 16 is connected to manifold 14 and extends upwards to vessel 18 at the surface. Drilling head 28 is lowered through riser 16 and locked into manifold 14 by actuating dogs 62 with ring 64. Drill string 20 is lowered from platform 18 through riser and manifold 14 into wellhead 12.

Drilling mud is pumped down through the bore of drill string 20 by mud pump 31 on platform 18. The mud travels down string 20, out drill bit 24, and back up annulus 22 toward drilling head 28. Drilling head 28 prevents the mud from continuing upward in annulus 22, diverting the mud through lateral passage 26. Pump 34 pumps surrounding seawater up return line 30, forcing the water through venturi 36 and creating a lower pressure in venturi 36. Mud return line 32 is connected to lateral passage 26, and mud is drawn from annulus 22, through passage 26, and into mud line 32. The mud then mixes with the seawater and is carried up mud line 32 to platform 18 where the sea water is separated out and mud is returned to sump 30.

MWD system 38 transmits acoustic signals in the drilling mud to transmit bottom hole pressure data to control module 40. Pressure sensors 42, 46 and flow meter 48 transmit data to control module 40 through umbilical 44. Control module 40 modulates pump 34 and pump 31 to balance the pressure of the drilling mud being channeled through string 20 and being drawn up through mud line 32 to control the wellbore back pressure and compensate for pressure variations in the well.

The advantages of the present invention include reducing the load on the main drilling mud pump by providing an auxiliary pump for pumping mud to the surface a separate conduit. The pump forces seawater through a venturi to draw the drilling mud into the conduit, thus the abrasive mud does not contact the components in the pump. Another advantage is that the bottom hole pressure can be automatically controlled by measuring pressure and flow volume and transmitting the measurements to a control system that modulates the rates of operation of the pumps. By increasing or decreasing the volume of mud moved by each pump, the pressure in the wellbore can be controlled. Also, the drilling head can be lowered and retrieved through the riser.

While the invention is shown in only one of its forms, it should be apparent to those skilled in the art that it is not so limited, but is susceptible to various changes without departing from the scope of the invention.

What is claimed is:

1. In an apparatus for drilling a subsea well, the apparatus having a subsea wellhead assembly enclosing a drill pipe, the drill pipe having a bore through which drilling fluid is delivered and a drill pipe annulus between the drill pipe and a bore of the well, an improved pump assembly for returning drilling fluid flowing up the drill pipe annulus to a surface vessel, the pump assembly comprising:

a submersible pump having an inlet and an outlet, the inlet being in fluid communication with seawater surrounding the wellhead assembly;

a conduit extending from the outlet of the pump to the surface vessel for delivering seawater to the surface vessel;

a venturi in the conduit for creating a lower pressure area due to the seawater flowing though the venturi; and a passage extending from the drill pipe annulus to the venturi for drawing drilling fluid from the drill pipe annulus into the conduit.

2. The apparatus of claim 1, wherein:

the pump is a centrifugal pump having at least one impeller and diffuser stage.

3. The apparatus of claim 1, further comprising:

a drilling head located in the annulus and above the passage, the drilling head sealing around the drill pipe.

4. The apparatus of claim 1, further comprising:

at least one pressure sensor in communication with the fluid in the drill pipe annulus; and a control system that receives a signal from the pressure sensor and controls a rate of operation of the submersible pump.

5. The apparatus of claim 1, further comprising:

a bottom-hole pressure sensor located near the bottom of the drill pipe for sensing pressure of the drilling fluid on the drill pipe annulus;

a signal transmitter assembly for transmitting data from the bottom-hole pressure sensor; and a control system that receives the data and controls the submersible pump in response thereto.

6. The apparatus of claim 1, further comprising:

a bottom-hole pressure sensor located near the bottom of the drill pipe for sensing pressure of the drilling fluid on the drill pipe annulus;

a signal transmitter assembly for transmitting data from the bottom-hole pressure sensor;

a detector located near the wellhead assembly for detecting and relaying the data from the transmitter;

a pump pressure sensor located in the conduit near the outlet of the submersible pump for sensing the pressure at the outlet of the pump; and a control system that receives the data from the detector and the sensor and controls the submersible pump in response thereto.

7. The apparatus of claim 1, further comprising:

a riser extending from the wellhead to the surface vessel; and a rotational drilling head that is run and retrieved through the riser, the drilling head landing above the passage and sealing any fluid in the riser surrounding the drill pipe from the drill pipe annulus and the bore of the well.

8. A well drilling assembly, comprising in combination:

a subsea wellhead;

a submersible, centrifugal pump having an inlet and an outlet, the inlet being in fluid communication with seawater surrounding the wellhead, the pump being adjacent the wellhead;

a conduit extending from the outlet of the pump to a surface vessel;

a venturi in the conduit for creating a lower pressure area due to the seawater flowing though the venturi;

a drilling head at the subsea wellhead for sealing around a string of drill pipe and blocking upward-flowing drilling fluid in the drill pipe annulus;

a passage extending from the wellhead to the venturi for drawing drilling fluid from the drill pipe annulus to the venturi.

9. The apparatus of claim 8, further comprising:

at least one pressure sensor in communication with the fluid in the drill pipe annulus; and a control system that receives a signal from the pressure sensor and controls a rate of operation of the submersible pump.

10. The apparatus of claim 8, further comprising:

a bottom-hole pressure sensor located near the bottom of the drill pipe for sensing pressure of the drilling fluid on the drill pipe annulus;

a signal transmitter assembly for transmitting data from the bottom-hole pressure sensor; and a control system that receives the data and controls the submersible pump in response thereto.

11. The apparatus of claim 8, further comprising:

a riser extending from the subsea wellhead to the surface vessel; and wherein the drilling head is retrievable through the riser.

12. A subsea well drilling apparatus, comprising:

a subsea wellhead;

a string of drill pipe extending from a surface vessel through the wellhead and into a well, defining a drill pipe annulus in the well;

a surface pump on the surface vessel for pumping drilling fluid down the drill pipe, which returns back up the drill pipe annulus;

a drilling head at the wellhead that seals around the drill pipe;

a subsea pump adjacent the wellhead;

a conduit leading from the subsea pump to the surface vessel;

a passage at the wellhead that diverts the drilling find to the subsea pump for returning through the conduit to the surface vessel;

a control system on the vessel that controls the flow rate of at least one of the pumps;

a bottom-hole pressure sensor that communicates bottom-hole pressure to the control system; and a subsea pump pressure sensor that communicates pressure at the subsea pump to the control system.

13. The apparatus of claim 12, further comprising:

a signal transmitter assembly for transmitting data from the bottom-hole pressure sensor;

a detector for detecting the for receiving data from the transmitter assembly, the detector being located near an upper end of the wellhead;

an electrical line for carrying the data from the detector to the surface vessel; and wherein the bottom-hole pressure sensor is located near the bottom of the drill pipe for sensing pressure of the drilling fluid on the drill pipe annulus.

14. The apparatus of claim 12, further comprising:

a pressure sensor located in the passage for measuring fluid pressure in the passage.

15. The apparatus of claim 12, further comprising:

a housing having a bore and being adapted to be connected between a wellhead and a riser, the riser extending to a surface vessel;

a tubular outer body adapted to land in the bore of the housing, the outer body being releasably secured in the housing, the outer diameter of the outer body adapted to be less than an inner diameter of the riser to enable the outer body to be run and retrieved through the riser;

a tubular inner body rotatably carried in the outer body and having a bore for receiving the drill pipe;

a hydraulically-energized gripping member in the bore of the inner body for gripping the drill pipe;

at least one port in the housing for connection to a hydraulic fluid line; and at least one port in the outer body for registering with the port in the housing to supply hydraulic fluid to the gripping member.

16. A method of controlling pressure of a drilling fluid within a bore of a subsea well being drilled by a string of drill pipe, the fluid returning up an annulus defined by an outer surface of the drill pipe and the bore of the well, the method comprising:

(a) using a surface pump on a surface vessel to pump the drilling fluid down the drill pipe;

(b) using a subsea pump at an upper end of the well to pump the fluid to the surface vessel;

(c) monitoring a pressure of the drilling fluid in the wellbore; and (d) modulating a rate of operation of at least one of the pumps for increasing or decreasing pressure of the drilling fluid in the well.

17. The method of claim 16, wherein:

step (c) comprises monitoring a bottom-hole pressure of the drilling fluid.

18. The method of claim 16, wherein:

step (c) comprises monitoring a bottom-hole pressure of the drilling fluid with a pressure sensor in the drill pipe, transmitting data from the pressure sensor to a detector at the upper end of the well, and transmitting data from the detector to the surface vessel via an electrical cable.

19. The method of claim 16 wherein step (b) comprises:

providing a submersible pump having an inlet and an outlet, the inlet being in fluid communication with seawater surrounding the wellhead assembly;

connecting a conduit extending from the outlet of the pump to the surface vessel for delivering seawater to the surface vessel;

providing a venturi in the conduit for creating a lower pressure area due to the seawater flowing though the venturi;

connecting a passage extending from the drill pipe annulus to the venturi for drawing drilling fluid from the drill pipe annulus into the conduit; and wherein the pump is a centrifugal pump having at least one impeller and diffuser stage.

20. A method of returning drilling fluid from a bore of a subsea well, the well being drilled by a string of drill pipe, drilling fluid being pumped down a bore of the pipe and returning up a drill pipe annulus between the drill pipe and the bore, the method comprising:

providing a submersible pump having an inlet and an outlet, the inlet being in fluid communication with seawater surrounding the wellhead assembly;

connecting a conduit to the outlet of the pump, the conduit extending to a surface vessel for delivering seawater to the surface vessel;

providing a venturi in the conduit for creating a lower pressure area due to the seawater flowing though the venturi; and connecting a passage extending from the drill pipe annulus to the venturi for drawing drilling fluid from the drill pipe annulus into the conduit.

21. The method of claim 20, comprising:

sealing the drill pipe annulus at the wellhead.

* * * * *

UNITED STATES PATENT AND TRADEMARK OFFICE

CERTIFICATE OF CORRECTION

PATENT NO. : 6,457,529 B2 
DATED : October 1, 2002
INVENTOR(S) : Ian Douglas Calder et al.

It is certified that error appears in the above-identified patent and that said Letters Patent is hereby corrected as shown below:

Column 2,
Line 54, before “lower” delete “is” and insert -- its --

Column 3,
Line 4, delete “an” and insert -- a --

Column 4,
Line 42, after “surface” insert -- through --

Column 5,
Line 67, after “annulus;” insert -- and --

Column 6,
Line 50, delete “the for” and insert -- and --

Signed and Sealed this

Eighteenth Day of February, 2003

JAMES E. ROGAN
*Director of the United States Patent and Trademark Office*